US006813330B1

(12) United States Patent
Barker et al.

(10) Patent No.: US 6,813,330 B1
(45) Date of Patent: Nov. 2, 2004

(54) HIGH DENSITY STORAGE OF EXCITED POSITRONIUM USING PHOTONIC BANDGAP TRAPS

(75) Inventors: Delmar L. Barker, Tucson, AZ (US); Nitesh N. Shah, Tucson, AZ (US); Harry A. Schmitt, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/630,077

(22) Filed: Jul. 28, 2003

(51) Int. Cl.[7] ..... G21G 1/00; G21C 13/00

(52) U.S. Cl. ..... 376/913; 376/156; 250/251; 250/493.1

(58) Field of Search ..... 376/913, 156; 250/251, 493.1

(56) References Cited

U.S. PATENT DOCUMENTS

| | | | | | |
|---|---|---|---|---|---|
| 4,864,131 | A | * | 9/1989 | Rich et al. | 250/308 |
| 4,867,939 | A | | 9/1989 | Deutch | |
| 4,933,950 | A | | 6/1990 | Ikegami | |
| 4,939,742 | A | | 7/1990 | Bowman | |
| 5,118,950 | A | | 6/1992 | Bahns et al. | |
| 5,206,506 | A | | 4/1993 | Kirchner | |
| 5,617,443 | A | | 4/1997 | Ikegami | |
| 5,887,008 | A | | 3/1999 | Ikegami | |
| 5,977,554 | A | | 11/1999 | Smith et al. | |
| 6,160,263 | A | * | 12/2000 | Smith et al. | 250/493.1 |
| 6,163,587 | A | * | 12/2000 | Hessels | 376/156 |
| 6,414,331 | B1 | | 7/2002 | Smith et al. | |
| 6,606,370 | B1 | * | 8/2003 | Kasprowicz | 376/113 |
| 2003/0048993 | A1 | * | 3/2003 | Shi et al. | 385/50 |

OTHER PUBLICATIONS

Weinstein, J.D. and K.G. Libbrecht, "Microscopic Magnetic Traps for Neutral Atoms", *Physical Review A*, The American Physical Society, vol. 52, No. 5, Nov. 1995, pp. 4004–4009.

Nieto, Michael Martin, et al., "Dense Antihydrogen: Its Production and Storage to Envision Antimatter Propulsion", Los Alamos Report LA–UR–01–3760, Dec. 12, 2001, pp. 1–12.

Howell, Richard H., "The Future: Intense Beams", Chapter 10 in *Positron Beams and Their Applications*, Paul Coleman Ed., World Scientific Publishing Co., Singapore, 2000, pp. 307–322.

Cassidy, D.B. and J.A. Golovchenko, "The Bose–Einstein Condensation of Positronium in Submicron Cavities", Chapter 6 in *New Directions in Antimatter Chemistry and Physics*, C.M. Surko and F.A. Gianturco, Eds., Kluwer Acaemic Publishers, Netherlands, 2001, pp. 83–99.

(List continued on next page.)

*Primary Examiner*—Nikita Wells
(74) *Attorney, Agent, or Firm*—Philip P. Berestecki; Leonard A. Alkov; Thomas J. Finn

(57) ABSTRACT

A device is provided that can capture and store electrically neutral excited species of antimatter or exotic matter (a mixture of antimatter and ordinary matter), in particular, excited positronium (Ps*). The antimatter trap comprises a three-dimensional or two-dimensional photonic bandgap (PBG) structure containing at least one cavity therein. The species are stored in the cavity or in an array of cavities. The PBG structure blocks premature annihilation of the excited species by preventing decays to the ground state and by blocking the pickoff process. A Bose-Einstein Condensate form of Ps* can be used to increase the storage density. The long lifetime and high storage density achievable in this device offer utility in several fields, including medicine, materials testing, rocket motors, high power/high energy density storage, gamma-ray lasers, and as an ignition device for initiating nuclear fusion reactions in power plant reactors or hybrid rocket propulsion systems.

40 Claims, 2 Drawing Sheets

OTHER PUBLICATIONS

Mills, Allen Paine, Jr., "Positronium Molecule Formation, Bose–Einstein Condensation and Stimulated Annihilation", *Nuclear instruments and Methods in Physics Research B,*, No. 192, Elsevier Science B.V., 2002, pp. 107–116.
Platzman, P.M. and A. P. Mills, Jr., "Possibilites for Bose Condensation of Positronium", *Physical Review B*, vol. 49, No. 1, Jan. 1, 1994, pp. 454–458.
Saito, Haruo and Toshio Hyodo, "Cooling and Quencing of Positronium in Porous Material", Chapter 7 in *New Directions in Antimatter Chemistry and Physics*. C.M. Surko and F.A. Ginaturco, Eds., Kluwer Academic Publishers, Netherlands, 2001, pp. 101–114.
Ackerman; J., et al., "Long–Lived States of Positronium in Crossed Electric and Magnetic Fields", *Physical Review Letters*, The American Physical Society, vol. 78, No. 2, Jan. 13, 1997, pp. 1999–202.
Schmelcher, P., et al., "Stabilization of Matter–Antimatter Atoms in Crossed Electric and Magnetic Fields", *Nuclear Instruments and Methods in Physics Research B*, No. 143, Elsevier Science B.V., 1998, pp. 202–208.
Schertzer, "Positronium in Crossed Electric and Magnetic Fields: The Existence of a Long–Lived Ground State", *Physical Review A*, The American Physical Society, vol. 58, No. 2, Aug. 1998, pp. 1129–1138.
Karlson, Antonella and Marvin H. Mittleman, "Stabilization of Positronium by Laser Fields", *Journal of Physics B*, vol. 29, 1996, IOP Publishing, U.K., pp. 4609–4623.
Wallen, P. and W.A. Mahoney, "The Postronium Radiative Combination Spectrum: Calculation in the Limit of Thermal Positrons and Low–Densities", *The Astrophysical Journal*, vol. 465, Jul. 1, 1996, The American Astronomical Society, USA, pp. 473–486.
Baldwin, Geroge C. and Johndale C. Solem, "Recoiless Gamma–Ray Lasers", *Review of Modern Physics*, vol. 69, No. 4, Oct. 1997, The American Physical Society, pp. 1085–1117.
Liang, Edison P. and Charles D. Dermer, "Laser Cooling of Positronium", *Optics Communication*, vol. 65, No. 6, Mar. 13, 1988, Elsevier Science Publishers B.V., pp. 419–424.
John, Sajeev and Jian Wang, "Quantum Optics of Localized Light in a Photonic Band Gap", *Physical Review B*, vol. 43, No. 16, Jun. 1, 1991, The American Physical Society, pp. 12 772–12 789.
John, Sajeev and Jian Wang, "Quantum Electrodynamics Near a Photonic Band Gap, Photon Bound States and Dressed Atoms", *Physical Review Letters*, vol. 64, No. 5, May 14, 1990, The American Physical Society, pp. 2418–2421.
John, Sajeev and Tran Quang "Photon–Hopping Conduction and Collectively Induced Transparency in a Photonic Band Gap", *Physical Review A*. vol. 52, No. 5, Nov. 1995, The American Physical Society, pp. 4083–4088.
John. Sajeev, "Quantum Optical Spin–Glass State of Impurity Two–Level Atoms in a Photonic Band Gap". *Physical Review Letters*, vol. 76, No. 8, Feb. 19, 1996. The American Physical Society, pp. 1320–1323.
Quang, Tran, et al., "Coherent Control of Spontaneous Emission Near a Photonic Band Edge: A Single–Atom Optical Memory Device", *Physical Review Letters*, vol. 79, No. 26, Dec. 29, 1997, The American Chemical Society, pp. 5238–5241.
John, Sajeev and Kurt Busch, "Photonic Bandgap Formation and Tunability in Certain Self–Organizing Systems", *Journal of Lightwave Technology*, vol. 17, No. 11, Nov. 1999, pp. 1931–1943.
Lin, Shawn–Yu and J.G. Fleming, "A Three–Dimensional Optical Photonic Crystal", *Journal of Lightwave Technology*, vol. 17, No. 11, Nov., 1999, pp. 1944–1947.
Roundy, David and John Joannopoulos, "Photonic Crystal Structure with Square Symmetry with each Layer and a Three–Deimensional Band Gap", *Applied Physics Letters*, American Institute of Physics, vol. 82, No. 22, Jun. 2, 2003, pp. 3835–3837.
Sievenpiper, D.R., et al., "3D Wire Mesh Photonic Crystals", *Physical Review Letters*, vol. 76, No. 14, Apr. 1, 1996, pp. 2480–2483.
Winn, Joshua N., et al., "Two–Dimensional Photonic Band-Gap Materials", *Journal of Modern Optics*, vol. 41, No. 2, 1994, pp. 257–273.
Yablonovitch, E. and T.J. Gmitter, "Photonic Band Structure: The Face–Centered–Cubic Case Employing Nonspherical Atoms", *Physical Review Letters*, vol. 67, No. 17, Oct. 21, 1991, pp. 2295–2298.
Zooreb, M.E., et al., "Complete Photonic Bandgaps in 12–Fold Symmetric Quasicrystals", Letters to Nature, *Nature*, vol. 404, Apr. 13, 2000, pp. 740–743.

* cited by examiner

HIGH DENSITY STORAGE OF EXCITED POSITRONIUM USING PHOTONIC BANDGAP TRAPS

TECHNICAL FIELD

The present invention is directed generally to devices for capturing and storing antimatter, and, more particularly, to an antimatter trap that can store relatively large, useful quantities of antimatter in the form of excited positronium, for relatively long times, as implemented by the use of photonic bandgap (PBG) structures. A Bose-Einstein Condensate state of excited positronium can be used to increase the storage density.

BACKGROUND ART

The basic building blocks of antimatter are the positively charged electron (positron) and the negatively charged proton (antiproton). Positrons have the same quantum characteristics as electrons, but have a positive electric charge. Antiprotons have the same quantum characteristics as protons, but have a negative electric charge. By combining equal numbers of negative and positive charges, an electrically neutral form of antimatter is constructed. The two simplest forms of electrically neutral antimatter, positronium (Ps) and antihydrogen ($\hat{H}$), are both analogs of the ordinary hydrogen atom (H). Positronium, which has the lowest rest mass of any known atom, consists of a positron and an ordinary electron in orbit around each other. Positronium is formed from a mixture of normal matter and antimatter, and this type of mixed normal matter/antimatter material will hereafter be referred to as exotic matter. Antihydrogen is pure antimatter, consisting of a positron in orbit around an antiproton. Like ordinary hydrogen, both Ps and $\hat{H}$ can form molecules (e.g., $Ps_2$ and $\hat{H}_2$).

Traps for electrically neutral normal matter particles have been available for many years, see, for example, the Ioffe-Pritchard Trap and the Time-Averaged Orbiting Potential Trap. Also, Weinstein et al. ("Microscopic magnetic traps for neutral atoms", Physical Review A, Vol. 52, pp. 4004–4009 (November 1995)) have proposed magnetic microtraps for storing very small amounts of electrically neutral atoms. These neutral atom traps have been difficult to implement as antimatter traps. Positronium is intrinsically unstable because it is composed of a particle and its antiparticle. From the ground state of positronium (e.g., Ps), the electron and positron annihilate in a very short time, generating two (or sometimes three) gamma rays. In free space, Ps self-annihilates in less than one microsecond. Antihydrogen is stable as long as it is confined within a region devoid of ordinary matter, a situation difficult to achieve in devices made of ordinary matter. Current neutral atom traps have a complex implementation, limited efficiency, and limited mass storage capacity. In contrast to the PBG trap of the present invention, current storage devices may have requirements (e.g., large mass, large volume, or high power usage) that preclude their use as an easily mobile trap. Mobility is a useful requirement for many applications of antimatter or exotic matter. For example, Smith et al. note in U.S. Pat. No. 6,160,263, entitled "Container for Transporting Antiprotons" and issued on Dec. 12, 2000, that "[a]ntimatter could have numerous commercial applications if it could be effectively stored and transported".

Traps for electrically charged particles have been available for many years, see, for example, the Cyclotron, the Paul Trap, and the Penning Trap. These devices have been used for the storage of electrically charged antimatter. However, they are capable of storing only relatively small amounts of electrically charged matter or electrically charged antimatter. Various proposals and suggestions for storing electrically charged antimatter have been made. For example, U.S. Pat. No. 5,118,950, entitled "Cluster Ion Synthesis and Confinement in Hybrid Ion Trap Arrays" and issued on Jun. 2, 1992, to John T. Bahns et al., discloses a cluster ion synthesis process utilizing a containerless environment to grow in a succession of steps cluster ions of large mass and well defined distribution. The cluster ion growth is said to proceed in a continuous manner in a plurality of growth chambers which have virtually unlimited storage times and capacities. U.S. Pat. No. 5,206,506, entitled "Ion Processing: Control and Analysis" and issued on Apr. 27, 1993, to Nicholas J. Kirchner, discloses an ion processing unit including a series of perforated electrode sheets, driving electronics, and a central processing unit, forming a variant of the well-known non-magnetic radio frequency quadrupole ion trap. Kirchner suggests that as electrically charged antimatter is produced, it can be introduced into each processing channel and held confined to an individual potential well. However, Kirchner does not provide a mechanism for the effective introduction of the electrically charged antimatter into his device, and he makes no mention of the critical vacuum requirements.

In another example, U.S. Pat. Nos. 5,977,554 and 6,160,263, both entitled "Container for Transporting Antiprotons" and issued on Nov. 2, 1999, and Dec. 12, 2000, respectively, to Gerald A. Smith et al., and U.S. Pat. No. 6,414,331, entitled "Container for Transporting Antiprotons and Reaction Trap" and issued on Jul. 2, 2002, to Gerald A. Smith et al., disclose a container for transporting antiprotons, including a dewar having an evacuated cavity and a cryogenically cold wall. A plurality of thermally conductive supports is disposed in thermal connection with the cold wall and extends into the cavity. An antiproton trap is mounted on the extending supports within the cavity. A scalable cavity access port selectively provides access to the cavity for selective introduction into and removal from the cavity of the antiprotons. The container is capable of confining and storing antiprotons while they are transported via conventional terrestrial or airborne methods to a location distant from their creation. An electric field is used to control the position of the antiprotons relative to the antiproton confinement region.

These discussions pertain to the storage of antiprotons or positrons, but none discloses or suggests a method for the storage of electrically neutral antimatter or electrically neutral exotic matter (in particular, excited positronium, Ps*) in an easily mobile form. There remains a need for an antimatter trap that can store relatively large quantities of electrically neutral antimatter or exotic matter in a relatively small package with relatively low power requirements. The PBG trap of the current invention could be used in combination with one of these conventional traps with considerable synergistic results. Indeed, as suggested by Michael M. Nieto et al., "Dense Antihydrogen: Its Production and Storage to Envision Antimatter Propulsion," Los Alamos Report LA-UR-01-3760, pp. 1–12 (Dec. 12, 2001), " . . . a space-certified storage system for neutral antimatter can not be obtained from a linear extrapolation of heretofore existing technologies".

When a particle, such as an electron, collides with its corresponding antiparticle (in this case the positron), the two particles annihilate and convert their total mass into energy. Thus, antimatter or exotic matter exists in the terrestrial environment only for very brief periods. There are many sources of positrons, e.g., commonly available radioactive isotopes such as $^{22}Na$ which exhibit $\beta^+$-decay, and positron/electron pair creation by high-energy gamma rays produced by electron beams or as a by-product of neutron capture processes such as $^{113}Cd(n,\gamma)^{114}Cd^*$. In this neutron capture process, the $^{114}Cd^*$ decays by emitting two or more gamma rays that can subsequently produce electron/positron pairs in a moderator such as tungsten (Richard Howell, "The Future: Intense Beams", in Positron Beams and Their Applications, ed. Paul Coleman, World Scientific: Singapore, pp. 307–322, 2000). However, the production of antiprotons (and hence antihydrogen) is limited to very high-energy collision processes carried out in very expensive, complex facilities such as accelerators. Another important differentiating property between positron-based exotic antimatter (e.g., Ps) and antiproton-based antimatter (e.g., $\hat{H}$) is the difference in the critical temperatures at which Ps and $\hat{H}$ transition to a Bose-Einstein Condensate (BEC). For Ps, the critical temperature can be as high as the easily achieved value of 300 degrees Kelvin, as discussed in D. B. Cassidy and J. A. Golovchenko, "The Bose-Einstein Condensation of Positronium in Submicron Cavities", in New Directions in Antimatter Chemistry and Physics, eds. C. M. Surko and F. A. Gianturco, Kluwer: Netherlands, pp. 83–99, 2001. For $\hat{H}$, the critical temperature is below one degree Kelvin, a situation achievable only with complex, expensive apparatus. Forming a BEC is of importance in achieving a high storage density. These contrasting properties of Ps and $\hat{H}$ make it clear that Ps is the more important form of antimatter or exotic matter for practical applications within the present framework of our technological and financial environment. However, most workers have dismissed attempts to stabilize Ps because, like many things in nature, the first level of consideration appeared to give a negative result (Ps self-annihilates from the ground state in less than a microsecond), but further investigations and new technological discoveries supercede the old ideas.

Several references in the scientific literature discuss the use of Bose-Einstein Condensation to promote the storage of $\hat{H}$ and/or Ps, see, e.g., Allen P. Mills Jr., "Positronium molecule formation, Bose-Einstein condensation and stimulated annihilation", Nuclear Instruments and Methods in Physics Research B, Vol. 192, pp. 107–116 (May 2002); P. M. Platzman and Allen P. Mills Jr., "Possibilities for Bose condensation of positronium", Physical Review B, Vol. 49, pp. 454–458 (January 1994); D. B. Cassidy and J. A. Golovchenko, "The Bose-Einstein Condensation of Positronium in Submicron Cavities", in New Directions in Antimatter Chemistry and Physics, eds. C. M. Surko and F. A. Gianturco (Kluwer: Netherlands), pp. 83–99 (2001); Haruo Saito and Toshio Hyodo, "Cooling and Quenching of Positronium in Porous Material", in New Directions in Antimatter Chemistry and Physics, eds. C. M. Surko and F. A. Gianturco (Kluwer: Netherlands), pp. 101–114 (2001); and Michael M. Nicto et al., "Dense Antihydrogen: Its Production and Storage to Envision Antimatter Propulsion", Los Alamos Report LA-UR-01-3760, pp. 1–12 (Dec. 12, 2001). However, these authors do not suggest a mechanism or apparatus for extending the lifetime of the stored Ps beyond the natural limit of less than a microsecond. Thus, these authors generally assume that they must work within the constraints imposed by this very short natural lifetime.

Using well-established mathematical models of physical laws, it has been shown that externally applied crossed electric and magnetic fields could be used to extend the lifetime of positronium (Ps) by many orders of magnitude (J. Ackermann et al., "Long-Lived States of Positronium in Crossed Electric and Magnetic Fields", Physical Review Letters, Vol. 78, pp. 199–202 (13 Jan. 1997); P. Schinelcher, J. Ackermann, and J. Shertzer, "Stabilization of matter-antimatter atoms in crossed electric and magnetic fields", Nuclear Instruments and Methods in Physics Research B, Vol. 143, pp. 202–208 (1998); J. Shertzer et al., "Positronium in crossed electric and magnetic fields: The existence of a long-lived ground state", Physical Review A, Vol. 58, pp. 1129–1138 (August 1998)). However, the authors do not provide a means for confining and storing large quantities of Ps, and their proposed apparatus calls for magnetic field strengths in excess of 10 T. Such magnetic field strengths are not amenable to easily mobile devices, as they require substantial laboratory equipment and power. It is possible to combine the method of Ackermann, Schmelcher, and Shertzer with the device of the present invention, with synergistic results. It has been predicted that externally applied laser fields could be used to extend the lifetime of ground-state Ps by up to a factor of 20 (Antonella Karlson and Marvin Mittleman, "Stabilization of positronium by laser fields", Journal of Physics B, Vol. 29, pp. 4609–4623 (1996)). Karlson and Mittleman do not provide a means for confining and storing large quantities of Ps, nor do they provide a means for extending the lifetime of Ps by many orders of magnitude. However, the technique of Karlson and Mittleman has synergistic potential with the present invention.

No patents have been found which disclose any method or apparatus for storing massive amounts of Ps for times longer than the natural sub-microsecond lifetime. Two patents are found (U.S. Pat. No. 4,867,939, entitled "Process for Preparing Antihydrogen" and issued on Sep. 19, 1989, to Bernhard I. Deutch, and U.S. Pat. No. 6,163,587, entitled "Process for the Production of Antihydrogen" and issued on Dec. 19, 2000, to Eric A. Hessels) that show how one might construct $\hat{H}$, but the inventors do not disclose any method or apparatus for storing, and transporting to a location distant from its creation, $\hat{H}$ or other species of antimatter or exotic matter.

There are many applications that would benefit from the development of an antimatter trap with the following desirable characteristics. The trap should store relatively large quantities of antimatter, should store electrically neutral species, should allow controlled release of the antimatter, and should have minimal size and power requirements making the device amenable to transportation. The device of the present invention is the only method that achieves these characteristics. The device of the present invention can supply enough antimatter to make a gamma-ray laser, or to initiate a controlled nuclear fusion reaction.

DISCLOSURE OF INVENTION

In accordance with the present invention, an antimatter storage device for electrically neutral excited species of antimatter or exotic matter is provided. The antimatter storage device comprises a three-dimensional or two-dimensional photonic bandgap (PBG) structure containing at least one PBG cavity in the PBG structure. The PBG cavity comprises a cavity wall embedded in the PBG structure and is surrounded by the PBG structure. The cavity contains a quantity of species selected from the group consisting of excited electrically neutral atoms and molecules of antimatter, and excited electrically neutral atoms and molecules of exotic matter.

Further in accordance with the present invention, a method of capturing antimatter is provided. The method comprises:

providing an antimatter capture device comprising the three-dimensional or two-dimensional PBG structure above; and introducing the species into at least one PBG cavity.

Also in accordance with the present invention, a method for exciting antimatter species to an excited state is provided. The method comprises:

providing an antimatter excitation device comprising the three-dimensional or two-dimensional PBG structure above; and exciting said species.

Still further in accordance with the present invention, a state of antimatter is provided, comprising the three-dimensional or two-dimensional PBG structure above, containing an array of PBG cavities. Each PBG cavity is separated from its nearest-neighbor cavities by a distance that is less than the photon localization length. Each cavity contains a quantity of the species.

Also in accordance with the present invention, a stable form of exotic matter is provided, comprising excited states of positronium (Ps*), confined within the cavities in the PBG structure, isolated from other electrons.

Yet further in accordance with the present invention, a combination of localized photons and partially excited species is provided, which forms a stationary-state superposition thereof, or a stable photon-species-cavity bound state, formed by an excited electrically neutral species of antimatter or exotic matter interacting with the cavity walls of the cavity located within the PBG structure. The interaction is mediated by photons.

Also in accordance with the present invention, a method of releasing gamma ray radiation is provided. The method comprises:

providing the antimatter excitation device above, the PBG cavity containing a quantity of excited positronium; and perturbing the PBG structure such that the index of refraction contrast, the geometry, the spacing, and/or the shape of the constituent components changes in such a way as to shift or turn off the bandgap that is responsible for maintaining the positronium in an excited state to thereby release the gamma ray radiation.

Still further in accordance with the present invention, a beam of species is provided, comprising excited electrically neutral atoms or molecules of antimatter or exotic matter emitted by the PBG structure above, where each PGB cavity contains a quantity of the species. The beam comprises the species channeled out of the PBG structure into a desired direction by opened linear defect waveguides in the PBG structure.

Finally, a particle beam is provided, comprising electrically charged antimatter emitted by the PBG structure. Each PBG cavity contains a quantity of excited electrically neutral atoms or molecules of antimatter or exotic matter, which are then ionized by an electric field, producing positively and negatively charged ions. In the case of positronium, this separates each positronium atom into its constituent positron and electron. Electric and magnetic fields are used to direct the ions or antimatter and/or normal matter out of the PBG device and into the desired direction.

BEST MODES FOR CARRYING OUT THE INVENTION

In accordance with the present invention, a mechanism is provided for trapping and storing relatively large quantities of excited electrically neutral positronium (Ps*) in a mobile device, along with a means for either allowing the Ps* to self-annihilate and release the stored energy, or for ionizing the Ps* and producing a directed positron beam. Further, a mechanism is provided for introducing positronium into the trap and achieving the appropriate excited state. Relatively high storage densities are achieved by using the Bose-Einstein Condensate (BEC) form of Ps*.

The approach of the present invention is based on a highly innovative trap for antimatter or exotic matter (mixture of antimatter and normal matter, e.g. positronium). The trap is constructed of photonic bandgap (PBG) structures containing at least one cavity, or an array of cavities. Recent theoretical and experimental work shows that it is possible to maintain atoms in an excited state by trapping them in cavities inside a three-dimensional PBG structure. The PBG behavior of the structure is dependent on a periodic contrast (one-dimensional, two-dimensional, or three-dimensional) in the index of refraction between the different constituent elements of the structure, the geometry and spacing associated with the arrangement of the constituent elements, and the shapes of the constituent elements. Examples of this type of material include the inverse opal backbone, macroporous silicon, colloidal crystals, woodpile structure, Yablonovite, and others well known in the field. It is important to note that given any two substances having sufficient index of refraction contrast that can be placed in a stable periodic arrangement, particular choices for the geometry, spacing, and shapes of the constituent substances of this periodic arrangement lead to the development of a photonic bandgap for a particular range of photon wavelengths. For two-dimensional lattices, the structure geometry can have symmetries such as triangular, rectangular, hexagonal, quasicrystal, etc. Generally, fully three-dimensional PBG structures are used for the PBG antimatter trap, but in certain cases it may be possible to use two-dimensional PBG structures. Open, connected structures (e.g., inverse opal) are preferred for vacuum attainment.

As a specific example, a discussion is provided herein on the trapping and storage of Ps*, which is considered to be the most important embodiment at the present time. As technology improves, the technique may in the future be applied to excited states of other electrically neutral species of antimatter or exotic matter, as previously noted. The technique of the current invention may be modified to trap electrically charged species. However, the achievable storage density for an electrically charged species will in general not be as high as the achievable storage density for an electrically neutral species.

Figure 1:
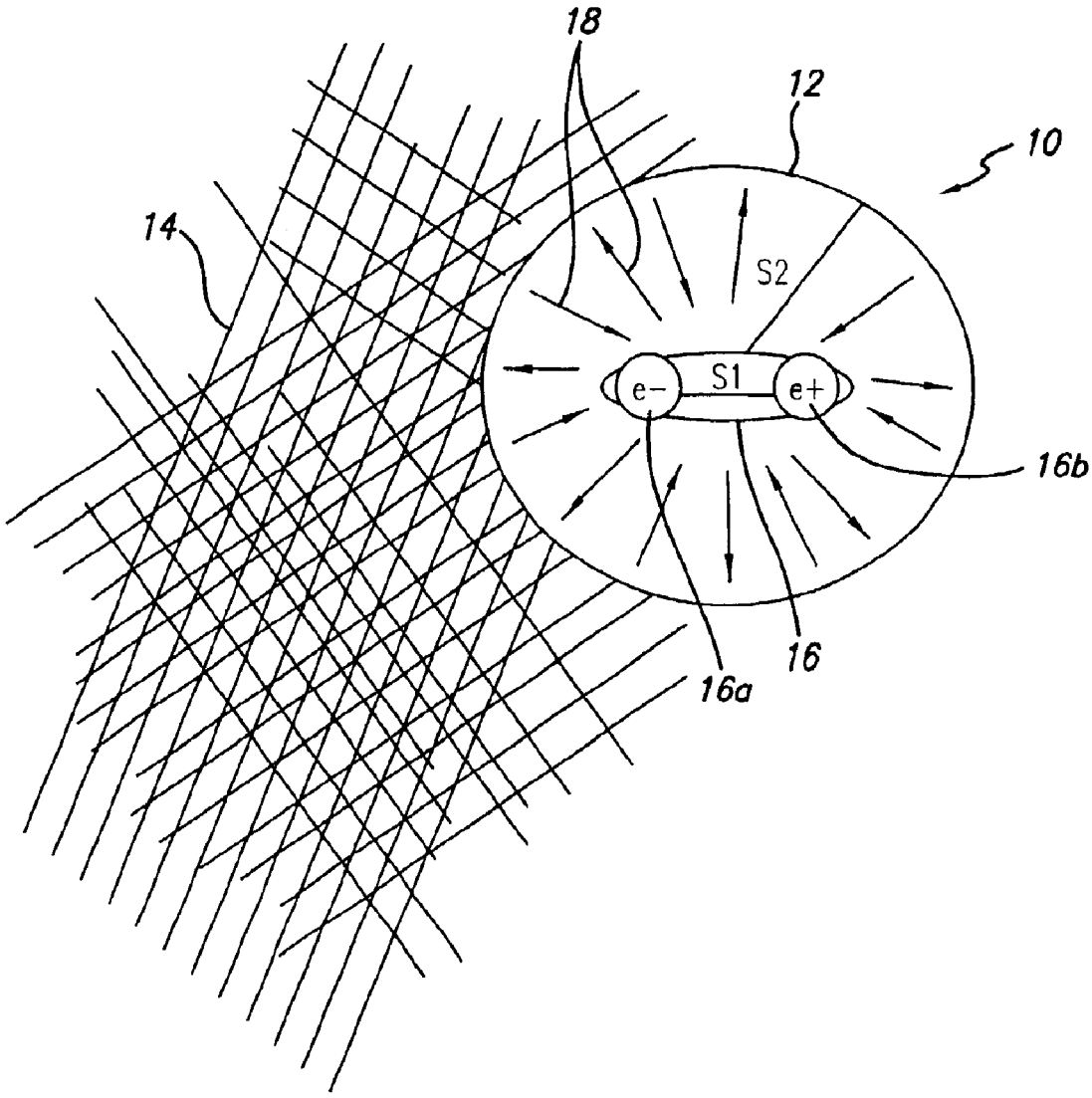
FIG. 1 is a schematic drawing depicting a photonic bandgap cavity in accordance with the teachings herein.

FIG. 1 schematically depicts a single PBG cavity 10. Specifically, a cavity wall 12 is surrounded by PBG material 14. Excited positronium (Ps*) 16, comprising an electron ($e^-$) 16*a* and a positron ($e^+$) 16*b*, is stored in the cavity 10. The Ps* can be stored in the form of a BEC, for applications requiring higher storage densities. The positron 16*b* can annihilate in one of two ways. In Ps* self-annihilation, the excited positronium Ps* 16 decays to the ground state and from the ground state the constituent electron 16*a* and positron 16*b* annihilate and are converted to two (or sometimes four) gamma rays for self-annihilation from the spin singlet state, or three (or sometimes five) gamma rays for self-annihilation from the spin triplet state. In Ps* pickoff annihilation, the positron 16*b* can annihilate with an electron at the wall 12 of the cavity 10, producing two (or sometimes four) gamma rays.

In FIG. 1, S1 is the distance between the electron 16*a* and the positron 16*b*. S1 must be large enough to prevent self-annihilation, but small enough to keep the electron and positron in orbit about each other (a bound state). This is accomplished by placing the positronium atom 16 in the highly excited Rydberg state Ps*. S2 is the distance between Ps* 16 and the cavity wall 12. S2 must be large enough to prevent contact of Ps* 16 with the wall 12, thereby maintaining the Ps* in isolation from other electrons that could initiate the pickoff process. The positronium 16 is forced to the center of the cavity 10 by the intermediate photon 18 that is constantly being exchanged by the positronium and the wall 12 of the cavity 10. This central force is created by the average action, over time, of many photon exchanges. This central force maintains the Ps* near the center of the cavity 10. Further, a second (or third, etc.) bandgap can be used to block the 203 GHz pickoff process, in conjunction with the fact that the Ps* 16 is maintained near the center of the cavity 10, in isolation from electrons available at the cavity wall 12 (e.g., the pickoff process is attenuated by two techniques: maintain the Ps* 16 far from electrons, and also use the PBG structure 14 to block the photons emitted during the pickoff process). It will be appreciated that a delicate balance between S1 and S2 gives a long lifetime to Ps* 16 and confines the Ps* within the cavity 10.

An excited species (e.g., Ps* 16) located deep inside this type of structure cannot decay by the emission of photons whose wavelengths lie within the bandgap, where the local radiative density of states is greatly reduced. When the excited species 16 tries to emit a photon 18, the photon undergoes multiple Bragg scatterings in the surrounding PBG structure 14 and is reflected back to the species 16, where it is reabsorbed. As noted above, this results in a stationary-state superposition of a localized photon and partially excited atom, or stable photon-atom-cavity bound state, and this process also provides a central force which tends to maintain the Ps* 16 near the center of the cavity 10. This unusual state of matter (or antimatter, or exotic matter) is predicted to be stable. It is noted that the excited species 16 is stable if it is ordinary matter at this point, but where positronium is concerned, it will self-annihilate into two gamma rays or three gamma rays unless it is in an atomic excited state, which inhibits this self-annihilation process.

There are two things trying to happen when the positronium is in an excited state: atomic decay to lower energy levels, finally arriving at the ground state (and subsequent self-annihilation), and self-annihilation directly from the excited state. The teachings of the present invention are directed to delaying self-annihilation from the ground state by inhibiting the atomic transition from the excited state to lower energy states. This is accomplished by the use of PBG structures that prevent the emission of transition photons, and by preparing the initial excited state such that decays to lower energy states are inhibited due to there being a naturally-occurring forbidden transition. The initial excited state is also selected, as described below, to have minimal probability of direct self-annihilation.

As noted above, once the bound antimatter or exotic matter atoms are created in a PBG structure 14, it is well known that these atoms can be placed in the proper long-lived excited state. This can be done using a laser tuned to a wavelength outside the bandgap. The proper long-lived excited state can also be achieved by creating the excited atom in a more highly excited state that cascades down to the proper excited state, from which further decay is inhibited by the surrounding PBG structure. Alternatively, the proper long-lived state can be achieved directly during the process for forming Ps*. Radioactive sources that exhibit $\beta^+$-decay (e.g., $^{22}$Na) are embedded in the PBG structure 14. As emitted high-energy positrons traverse the PBG material 14, they are slowed, and as they pass through the cavity wall 12, they capture an electron and form positronium in a Rydberg state. This Rydberg state can be the desired state, or it can be a state of higher energy (cascades down to the desired state), or it can be a state of lower energy (laser pumped up to a higher state). If higher storage densities are required for a particular application, then a BEC of Ps* can be established by any of a number of cooling techniques well known in the literature.

Figure 2:
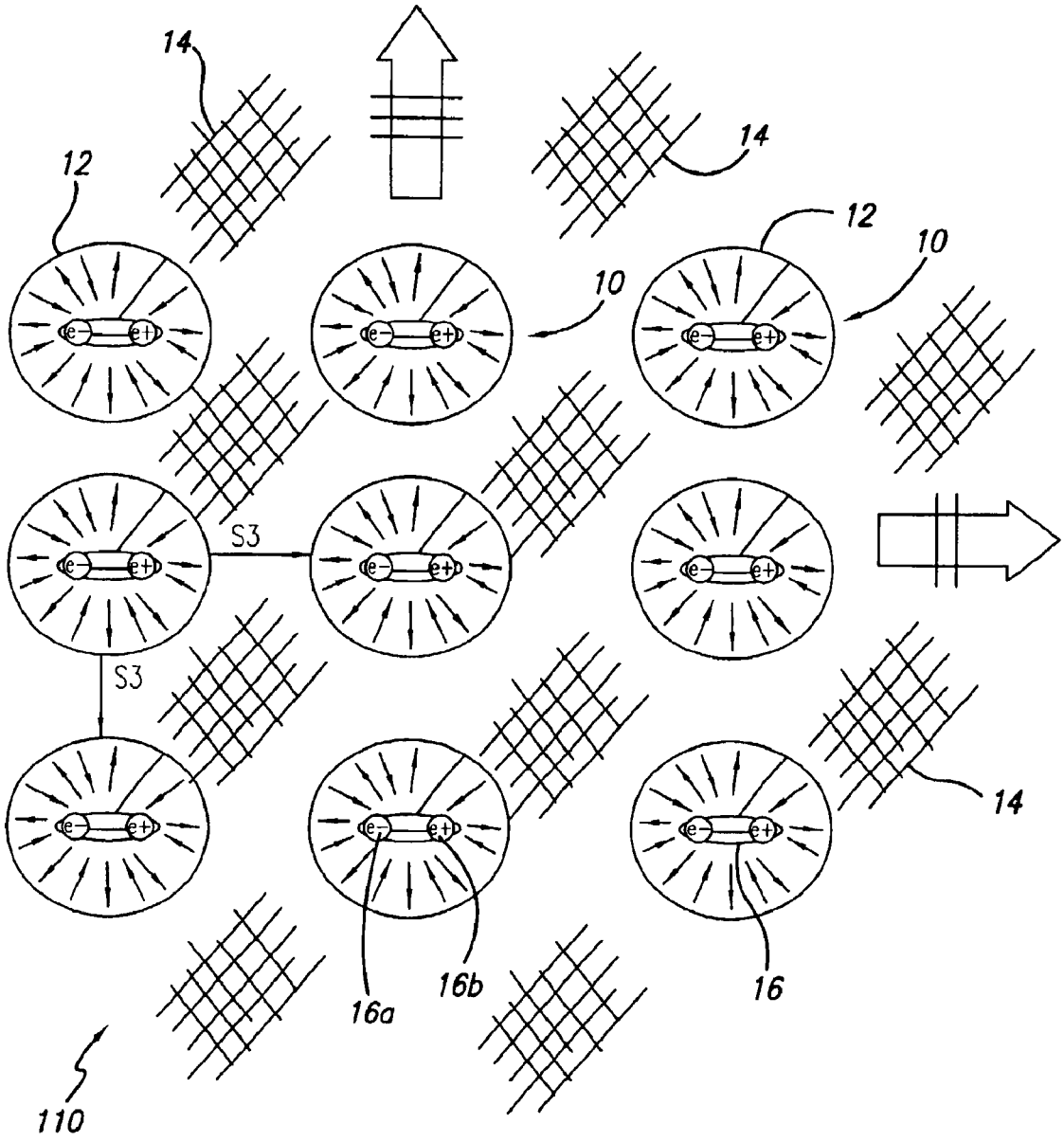
FIG. 2 is a schematic drawing depicting an array of Ps*-containing cavities found within the antimatter trap's PBG structure.

Although only one cavity 10 is depicted in FIG. 1, it will be appreciated that, in fact, there is a three-dimensional array of cavities 10 in the PBG device, each capable of storing multiple atoms of Ps* 16. FIG. 2 depicts such an array 110 of cavities 10. Each cavity 10 is separated from its nearest neighbor cavities by a distance S3. As noted earlier, if S3 is greater than the photon localization length $\xi$, then the cavities 10 will be isolated from each other. However, if S3 is less than the photon localization length $\xi$, then the cavities 10 will be able to interact, a situation postulated to result in a new collective atomic steady state (a "shadow crystal").

The PBG structure of the present invention preferably comprises materials and geometry that together provide bandgaps at frequencies specific to each species to be stored in the antimatter storage device. The PBG behavior of the structure is dependent on a periodic contrast in the index of refraction between the different constituent elements of the structure, the geometry and spacing associated with the arrangement of the constituent elements, and the shapes of the constituent elements.

It is important to note that given any two substances having sufficient index of refraction contrast that can be placed in a stable periodic arrangement, particular choices for the geometry, spacing, and shapes of the constituent substances of this periodic arrangement lead to the development of a photonic bandgap for a particular range of photon wavelengths. It is also important to note that if the periodic arrangement or index of refraction contrast is disturbed, the properties of the bandgap change, and the bandgap frequencies can be shifted or the bandgap effect can be entirely turned off. Controlled, recoverable structural deformation can be achieved, for example, using actuation by piezoelectric or microelectromechanical (MEM) devices, or by passing shock waves through the PBG structure. One-time destructive deformation can be achieved in many ways, including crushing or pulverizing the material. The index of refraction contrast can be altered by changing the index of refraction of the constituent elements, for example by applying external electric fields to an electro-optically active constituent such as birefringent nematic liquid crystal.

If positronium is stored in the Rydberg state with principal quantum number n=33, a de-excitation cascade starting with a decay to the state with n=32 must be blocked. The decay from the state with n=32 takes place by the emission of a photon with a frequency of 95.9 GHz, or 3.13 mm. Therefore, the PBG structure must have a bandgap which includes 3.13 mm. Further, a second bandgap is used to block the pickoff process occurring at 203 GHz, or 1.48 mm. The PBG structure can be formed of air holes laid out in a quasicrystal geometry in an embedding matrix of silicon nitride, which is known to produce multiple bandgaps; for example, see FIG. 2 of M. E. Zoorob et al., "Complete photonic bandgaps in 12-fold symmetric quasicrystals," Nature, Vol. 404, pp. 740–743 (13 Apr. 2000).

The de-excitation cascade could also start with the emission of a photon with wavelength much different from the 1.48 mm wavelength associated with the pickoff process. In such cases, superimposed PBG structures can be used. For example, positronium decays from the state with n=11 to the state with n=10 by the emission of a photon with a frequency of 2.86 THz, or 105 $\mu$m. A PBG structure for blocking photons with a wavelength of 105 $\mu$m can be formed of a body-centered tetragonal lattice of silicon rods and veins, see for example D. Roundy and J. Joannopoulos, "Photonic crystal structure with square symmetry within each layer and a three-dimensional band gap," Applied Physics Letters, Vol. 82, pp. 3835–3837 (2 Jun. 2003). Superimposed on this structure can be another PBG structure for blocking photons with a wavelength of 1.48 mm. This PBG structure can consist, for example, of copper wires arranged in the three-dimensional diamond lattice of D. F. Sievenpiper et al, "3D Wire Mesh Photonic Crystals", Physical Review Letters, Vol. 76, pp. 2480–2483 (1 Apr. 1996).

Other examples of three-dimensional PBG structures useful for the current invention are well known in the literature. The inverse opal structure is discussed by S. John and K. Busch, "Photonic Bandgap Formation and Tunability in Certain Self-Organizing Systems", Journal of Lightwave Technology, Vol. 17, pp. 1931–1943 (11 Nov. 1999). The woodpile structure is discussed by S. Lin and J. G. Fleming, "A Three-Dimensional Optical Photonic Crystal", Journal of Lightwave Technology, Vol. 17, pp. 1944–1947 (11 Nov. 1999). Yablonovite is discussed by E. Yablonovitch et al, "Photonic Band Structure: The Face-Centered-Cubic Case Employing Nonspherical Atoms", Physical Review Letters, Vol. 67, pp. 2295–2298 (21 Oct. 1991). Two-dimensional PBG structures useful for the current invention have been extensively reviewed in the literature; see, for example, J. N. Winn et al., "Two-dimensional photonic band-gap materials", Journal of Modern Optics, Vol. 41, pp. 257–273 (1994) and J. D. Joannopoulos et al, "Photonic Crystals: Molding the Flow of Light", Princeton: Princeton University Press (1995).

Nowhere in the open scientific literature or in patent prior art are there suggestions that one can trap excited positronium 16 in a PBG cavity 10. Specifically, it is certainly not obvious that Ps* can or should be trapped using cavities in PBG structures, such that the lifetimes against self-annihilation and pickoff annihilation with electrons in the cavity walls 12 are greatly enhanced. Self-annihilation and pickoff annihilation are not relevant when trapping atoms or molecules composed of ordinary matter. To the best of their knowledge, the present inventors are the first to recognize that by balancing the two distance parameters S1 and S2 (see FIG. 1), it becomes possible to extend the lifetime of Ps*, and other excited neutral species of antimatter or exotic matter as discussed above, by many orders of magnitude without extensive apparatus. The parameter S2 is kept at a maximum, with the beneficial action of preventing the Ps* 16 from contacting electrons in the cavity wall 12. This prevents pickoff annihilation processes with electrons available at the cavity surface.

The lifetime against self-annihilation can be a few seconds to a few years. The lifetime is chosen based on the application. For example, a lifetime of seconds is appropriate for the medical field, whereas a lifetime of years is appropriate for interplanetary propulsion.

In positronium, the separation S1 between the electron 16*a* and the positron 16*b* increases with the principle quantum number n, where n can be at least as high as 134 (P. Wallyn et al., "The Positronium Radiative Combination Spectrum: Calculation in the Limit of Thermal Positrons and Low Densities", Astrophysical Journal, Vol. 465, pp. 473–486, 1 Jul. 1996). In the technical language of quantum mechanics, this is expressed by stating that as n increases, the overlap of the wave functions of the electron and positron decreases, and they can be considered further apart (larger S1). Karlson and Miitleman (Antonella Karlson and Marvin Mittleman, "Stabilization of positronium by laser fields", Journal of Physics B, Vol. 29, pp. 4609–4623, 1996) note the following:

> "Positronium (Ps) is an unstable system. Singlet Ps annihilates mainly by emission of two gamma quanta with a lifetime of $\Gamma^s=1.25\times10^{-10}$ s and the triplet state mainly by three gamma emission and $\Gamma^{tr}=1.4\times10^{-7}$ s. The annihilation reaction is caused by a quantum electrodynamical interaction term in the Hamiltonian, whose range is of the order of the Compton wavelength $\lambda_c$ [$\lambda_c=2.42\times10^{-12}$ m]. On the scale of the Ps atom, this is essentially a zero-range operator. Thus, the decay rate is proportional to the absolute value squared of the Ps wavefunction at the origin, where the two particles are in contact. Since the wavefunction of Ps vanishes at the origin for all but states with angular momentum zero, Ps annihilates for all practical purposes only from S states. For them the annihilation rate depends on the principal quantum number as $n^{-3}$. For states with higher angular momentum l, the annihilation rate is smaller than the rate for the respective S state by a factor of $(a_B/\lambda_c)^{-21}$ . . . , where $a_B$ is the Bohr radius [$a_B=52.9\times10^{-12}$ m] . . . Therefore, the lifetime of these states is considerably larger."

It is then clear that the lifetime $\Gamma^{n,l}$ of an excited state of positronium with principal quantum number n and angular momentum l is related to the lifetime of the ground state of positronium $\Gamma^0$ (either the singlet state or the triplet state) by $\Gamma^{n,l}=\Gamma^0 n^3(a_B/\lambda_c)^{2l}=\Gamma^0 n^3(21.8)^{2l}$.

For an excited state with angular momentum l=0, the lifetime is increased over that of the ground state by a factor of $n^3$. For example, an excited state with n=134 and l=0 has a lifetime extended by a factor of approximately two million over that of the ground state. If Ps* could be maintained in the spin triplet state with n=134 and l=0, e.g., by using the device of the present invention, the lifetime of the spin triplet Ps* would be extended from $1.4\times10^{-7}$ s to approximately 0.3 s. If we prepare the excited state to have a non-zero value for the angular momentum l, then the lifetime is enhanced by another factor of $(21.8)^{2l}$. For example, an excited state with n=134 and l=1 has a lifetime extended by a factor of approximately one billion over that of the spin triplet form of the ground state. An excited state with n=134 and l=3 has a lifetime extended by a factor of approximately $2.6\times10^{-14}$ over that of the spin triplet form of the ground state, resulting in a lifetime of $\Gamma^{134,3}=3.6\times10^7$ s=1.15 years. It is recognized by the present inventors that the method of Ackermann, Schmelcher, and Shertzer may be synergistically used in conjunction with the device of the present invention to extend the lifetime of Ps*. However, this may result in the need for substantial apparatus that is not amenable to a mobile device, but could certainly be used for applications that allow substantial apparatus (e.g., power plant or interplanetary propulsion system).

As with the he lifetime against self-annihilation, the lifetime here can also be a few seconds to a few years. Again, the lifetime is chosen based on the specific application, where, for example, a lifetime of seconds is appropriate for the medical field, whereas a lifetime of years is appropriate for interplanetary propulsion.

It is noted above that the scientific literature contains references to forming a BEC of positronium in its ground state, Ps. The present inventors have recognized that a BEC can also be formed using positronium in its excited state, Ps* 16, and this BEC can be trapped and stored in the device of the present invention. Since there is no prior art discussion of forming and using a BEC of Ps*, the present inventors consider this to be a new application for storing Ps. Assume, for example, that $N_a=10^9$ Ps* atoms can be stored in a single cavity 10, in the form of a BEC. Further, assume that at least $N_c=10^{12}$ cavities/cm$^3$ can be created as arrays 110 in PBG materials 14 such as the inverse opal structures noted above. This gives a Ps* number density $\rho_{Ps^*}=N_a\times N_c=10^{2l}$ Ps*/cm$^3$. The energy released upon the self-annihilation of positronium is 1.022 MeV/Ps*. For the storage conditions of this example, the energy storage density is $\rho_E=\rho_{Ps^*}\times 1.022$ MeV/Ps*$=10^{27}$ eV/cm$^3$~$10^8$ J/cm$^3$. If 1 cm$^3$ of this material is released in 1 ms, the resulting power is $10^8$ J/$10^{-3}$ s$=10^{11}$ W, or 100 Gigawatts. Assume also that the cavities have a typical diameter of 1 $\mu$m, as is commonly achievable using the inverse opal geometry. Then, from FIG. 4 of Cassidy and Golovchenko, supra, it is clear that the Ps* can undergo a transition to the BEC state at a temperature approaching room temperature, or approximately 300 degrees Kelvin. Given the expected Ps* number density per cavity, the device can be fashioned to have cavity diameters larger or smaller, in order to achieve a transition to the BEC state at a particular desired temperature.

The antimatter may be introduced into the antimatter trap by a variety of methods, including, but not limited to, the following three methods: (1) The antimatter (e.g., positrons) from radioactive sources or accelerator sources can be injected through a velocity moderator (e.g., tungsten). The velocity moderator can be located within the PBG material 14 of the PBG device, or it can be located outside the PBG device. (2) Positrons and electrons can be pair-produced by high-energy gamma rays generated by electron beams or as a by-product of neutron capture processes such as $^{113}$Cd(n, $\gamma$)$^{114}$Cd* (see above). The neutrons can impinge on the PBG device in a collimated beam, or the PBG device can be placed inside a nuclear reactor in which there is an abundance of neutrons. (3) A radioactive material that emits positrons (e.g., $^{22}$Na) can be embedded in the PBG structure 14, resulting in a "self-charging" device.

A positron 16*b* that has been introduced into the PBG structure by any of the foregoing methods travels through the material, and when it encounters a cavity 10, the positron 16*b* picks up an electron 16*a* as it traverses the cavity wall 12. This process results in the formation of an excited positronium atom 16 in the cavity 10. The formed excited state could have principal quantum number n different from that desired for the trapped state. If the created Ps* is in a state with energy lower than desired, then a tuned laser can be used to pump the Ps* up to (or above) the desired excited state. If the created Ps* is in a state with energy higher than desired, or if it has been pumped up to a state with energy higher than desired, then the Ps* can then be allowed to cascade decay down to the desired state, at which point the surrounding PBG structure prevents further decay and preserves the desired state.

All current traps for electrically neutral species share the common disadvantage of not being able to capture and store relatively large quantities of positronium for relatively long times. All current traps for electrically neutral species are generally not easily portable, due to operating requirements calling for relatively high mass, relatively high volume, and relatively high power requirements. The present invention should produce a mobile storage container that can trap relatively large quantities of positronium, and store it for relatively long times (orders of magnitude longer than the natural in vacuo lifetime of positronium). The device of this invention would have utility in several fields, including medical applications, materials testing applications, rocket motors, high power/high energy density storage, and as an ignition device for initiating nuclear fusion reactions in power plant reactors or hybrid rocket propulsion systems.

It may also be possible to coherently annihilate all of the Ps* stored in the photonic bandgap (PBG) device of the present invention. This makes possible a PBG device as a component of a 511 KeV gamma ray laser (GRASER) operating from the annihilation radiation. The GRASER is well described in the scientific literature. One method for developing a GRASER is based on the generation of gamma rays from the decay of excited nuclei (e.g., George C. Baldwin and Johndale C. Solem, "Recoilless gamma-ray lasers", Reviews of Modem Physics, Vol. 69, pp. 1085–1117, 4 Oct. 1997, or U.S. Pat. No. 4,939,742 entitled "Neutron-Driven Gamma-Ray Laser" and issued to Charles D. Bowman on Jul. 3, 1990). Another method using a Bose-Einstein Condensate (BEC) of electrons stored in a high-energy electron storage ring or collider is disclosed in U.S. Pat. No. 5,887,008, entitled "Method and Apparatus for Generating High Energy Coherent Electron Beam and Gamma-Ray Laser" and issued to Hidetsugu Ikegami on Mar. 23, 1999. Another method is based on the generation of gamma rays via the annihilation of electrons and positrons. Hidetsugu Ikegami discloses a method of producing a GRASER by combining an electron beam and a positron beam using accelerators, in U.S. Pat. No. 4,933,950, entitled "Generating Method for Free Positronium Radiation Light and Apparatus Used in this Method" and issued on Jun. 12, 1990) and in U.S. Pat. No. 5,617,443, entitled "Method and Apparatus for Generating Gamma-Ray Laser" and issued on Apr. 1, 1997). Using a BEC of positronium to generate a GRASER is discussed by Edison P. Liang and Charles D. Dermer in "Laser Cooling of Positronium", Optics Communications, Vol. 65, pp. 419–424, 15 Mar. 1988, and by Allen P. Mills Jr. (May 2002, supra).

The methods for producing a GRASER using a BEC of electrons or a combination of a positron beam and an electron beam require substantial apparatus and physical plant, and sufficient cooling mechanisms to develop a BEC for the former case. For using a BEC of Ps to generate a gamma ray laser, sufficient storage densities must be achieved. The present inventors are the first to describe a way to achieve sufficient storage density for a Ps BEC-based GRASER, with the absolute numbers of stored Ps atoms exceeding what is possible in the standard charged plasma traps or the conventional neutral atom traps. Furthermore, the present inventors describe a device that does not require substantial apparatus and physical plant. Moreover, in the present device, the Ps BEC is maintained for lifetimes many orders of magnitude greater than that in the prior art, allowing the user great flexibility in the timing for releasing the energy in the form of a GRASER.

Mills (May 2002, supra) calculates that having $10^{12}$ Ps atoms stored in the spin triplet form of the ground state in a cavity with radius 200 nm and length 1 mm is sufficient for radiation amplification, upon the application of a pulse of radiation tuned to the hyperfine transition such that the Ps atoms decay from the spin triplet ground state to the spin singlet ground state and subsequently self-annihilate. The device of the present invention meets, and far exceeds, these storage density requirements.

It should be noted that depending on the application for the present device, it may be desired for the stored Ps to annihilate from the singlet ground state, so that two 511 KeV gamma rays are produced. The decay mode preferred by the spin triplet ground state results in three gamma rays whose total energy sums to 1.022 MeV, allowing the possibility of gamma rays with energy small compared to 511 KeV. Hence, it is necessary to control the PBG such that the stored excited positronium can be stimulated to go to the ground state, where both the spin singlet and spin triplet states are populated, and then modify the decay of the spin triplet state to either self-annihilation into three gamma rays, or further decay to the spin singlet state and subsequent self-annihilation into two gamma rays. De-excitation from the excited state can be accomplished by several mechanisms, including shifting or turning off the photonic bandgap by applying stress to the PBG lattice (e.g., by using piezoelectric actuator devices attached to the PBG lattice) or by using any method to sufficiently change the symmetry, lattice constant, or the refractive index contrast ratio of the PBG structure. By controlling the energy level decay path, it is possible to use multiple photonic bandgaps to route the decay to the ground state. As the atoms drop to the ground state, sending a gamma ray pulse with energy 511 KeV through the device in the desired direction will stimulate coherent annihilation, rather than allowing self-annihilation to produce isotropic radiation. Also, as the atoms drop to the ground state, applying a pulse of radiation with frequency 203 GHz (the frequency separating the spin triplet and spin singlet states) can cause the spin triplet population to decay to the spin singlet state rather than self-annihilating directly from the spin triplet state. It is also noted that one can encase the present device in a material with a high cross section for 511 KeV gamma rays, leaving open an aperture in the desired direction for the GRASER. The encasing material will absorb gamma rays not traveling in the desired direction, possibly generating waste heat that can be captured and used for other purposes such as energy production via thermoelectric conversion. If the self-annihilation is allowed to occur from the spin triplet state, many gamma rays with energy less than 511 KeV are produced. The gamma rays with energy less than 511 KeV are easier to capture in a material than the 511 KeV gamma rays.

As described above, the antimatter trap disclosed and claimed herein can store excited electrically neutral species, e.g., an excited state of positronium (Ps*). The antimatter trap comprises the three-dimensional or two-dimensional photonic bandgap (PBG) structure, in which carefully chosen periodic variations in the amplitude of the local index of refraction N(x,y,z) exist in all three spatial dimensions. These periodic variations in the amplitude of N(x,y,z) have length scales comparable to the central wavelength of the bandgap. Excited species soon attempt to reach their ground state via the emission of one or more photons. An excited species located within a cavity deep inside the type of PBG structure disclosed in this invention cannot decay by the emission of photons whose wavelengths lie within the bandgap, where the local radiative density of states is greatly reduced. When the excited species tries to emit a photon, the photon is reflected by multiple Bragg scatterings within a photon localization length $\xi$ (typically approximately several photon wavelengths) back to the species, where it is reabsorbed. In effect, the species is dressed by its own radiation field (Sajeev John and Jian Wang, "Quantum optics of localized light in a photonic band gap", Physical Review B, Vol. 43, pp. 12772–12789, 1 Jun. 1991).

The result is a stationary-state superposition of a localized photon and partially excited atom, or stable photon-atom-cavity bound state. This unusual state of matter is predicted to be stable (Sajeev John and Jian Wang, "Quantum electrodynamics near a Photonic Band Gap: Photon Bound States and Dressed Atoms", Physical Review Letters, Vol. 64, pp. 2418–2421, 14 May 1990). If adjacent cavities are located within the photon localization length $\xi$, the localized photon can be shared among excited species via the Resonant Dipole-Dipole Interaction (RDDI). The RDDI process can protect the excitation energy from dissipation through nonradiative relaxation channels, further enabling the extension of the lifetime of the excited state (Sajeev John and Tran Quang, "Photon-hopping conduction and collectively induced transparency in a photonic band gap", Physical Review A, Vol. 52, pp. 4083–4088, Nov. 1995). It is postulated that the collective properties of excited species of ordinary matter located in cavities within a PBG structure with inter-cavity separations less than the photon localization length $\xi$ result in the occurrence of a new collective atomic steady state (a "shadow crystal"), the electromagnetic analog of a spin-½ dipolar glass, and an associated Bose-glass state of photons in the cavity mode (Sajeev John and Tran Quang, "Quantum Optical Spin-Glass State of Impurity Two-Level Atoms in a Photonic Band Gap", Physical Review Letters, Vol. 76, pp. 1320–1323, 19 Feb. 1996).

Whereas researchers have considered these effects only for ordinary matter, the present invention extends these concepts to trapping and storing excited states of electrically neutral species of antimatter or exotic matter, in particular exotic matter in the form of excited positronium (Ps*). As defined herein, the term "exotic matter" refers to a mixture of normal matter and antimatter. The technique of this invention can be applied to excited states of antihydrogen ($\hat{H}$), protonium (bound state of a proton and an antiproton), antimuonium (bound state of a positron and a negatively charged muon), molecular positronium (e.g., $Ps_2$ and in general $Ps_n$), molecules containing positronium or positronium molecules bound to ordinary matter (e.g., PsH, CuPs, LiPs, etc.), and electrically neutral molecules containing a positron bound to ordinary matter having a single negative charge.

Once the bound neutral antimatter or bound neutral exotic matter atoms are created in a PBG structure, it is well known that these atoms can be placed in the proper long-lived excited state using a laser tuned to a wavelength outside the bandgap (Quang et al., "Coherent Control of Spontaneous Emission near a Photonic Band Edge: A Single-Atom Optical Memory Device", Physical Review Letters, Vol. 79, pp. 5238–5241, 29 Dec. 1997) The proper long-lived excited state can also be achieved by creating the excited atom (e.g., Ps*) in a more highly excited state that cascades down to the proper excited state, from which further decay is inhibited by the surrounding PBG structure. Alternatively, the proper long-lived state can be achieved directly during the process for forming Ps*. For Ps*, the de-excitation mechanism known as the pickoff process can also be blocked by the PBG structure. In the pickoff process, a positronium atom in which the positron and electron have parallel spins (spin triplet: ortho-positronium) interacts with a nearby electron possessing spin opposite that of the positron. This results in a final state in which the positronium atom's electron and positron have antiparallel spins (spin singlet: para-positronium). One of the periodicities in the PBG structure can be tuned to block the spin-flip transition associated with the pickoff process.

By using active elements in the PBG structure, waveguides can be opened between the cavity or array of cavities and an exit aperture or exit apertures, and the species are channeled into the waveguides. While the excited species are traveling in the waveguides, the surrounding PBG structure continues to inhibit decay to the ground state (therefore preventing the subsequent annihilation from the ground state). As the excited species exit the structure, they are no longer blocked from decaying to the ground state. The species decay to the ground state and annihilate, releasing energy. The energy can be captured by an encompassing absorbing material, heating the material, and thermoelectric conversion processes can be used to produce electricity.

Prior to their departure from the device, the electrically neutral excited species can be ionized by an electric field. This separates the electrically neutral species into positively and negatively charged ions. In the case of positronium, this separates each positronium atom into its constituent positron and electron. Electric and magnetic fields can then be used to direct the ions or antimatter and/or normal matter out of the PBG device and into the desired direction, forming a particle beam. As the beam of antimatter ions interacts with ordinary matter, annihilation occurs, a process useful for example as a drill or for ablation.

The PBG trap has three key advantages over prior art neutral species traps (e.g., the Ioffe-Pritchard Trap, the Time-Averaged Orbiting Potential Trap, and the magnetic microtrap). First, in contrast with the Ioffe-Pritchard Trap and the Time-Averaged Orbiting Potential Trap, the PBG trap uses substantially less energy, weighs substantially less, and occupies substantially less volume. Second, in contrast with the Ioffe-Pritchard Trap and the Time-Averaged Orbiting Potential Trap, by using microcavities regularly spaced throughout a PBG structure the PBG trap stores electrically neutral antimatter or exotic matter in a scalable distributed manner, not in a non-scalable clump. Third, in contrast with the Ioffe-Pritchard Trap, the Time-Averaged Orbiting Potential Trap, and the magnetic microtrap, the PBG trap extends the lifetime of the trapped excited species by many orders of magnitude over the lifetime of the excited species when located outside the PBG trap. In contrast with prior art lifetime extension methods using externally applied crossed electric and magnetic fields or externally applied laser fields, the PBG trap provides a mechanism for capturing and storing large quantities of the excited electrically neutral species, and the PBG trap extends the lifetime of the trapped excited electrically neutral species by many orders of magnitude more than the factor of 20 achievable using the externally applied laser fields.

It is to be understood that the present invention is not limited to the precise constructions herein disclosed and shown in the drawings, but also comprises any modifications or equivalents within the scope of the claims.

What is claimed is:

1. An antimatter storage device for electrically neutral excited species of antimatter or exotic matter, said antimatter storage device comprising a three-dimensional or two-dimensional photonic bandgap (PBG) structure containing at least one PBG cavity in said PBG structure, said PBG cavity comprising a cavity wall embedded in said PGB structure and surrounded thereby and containing a quantity of species selected from the group consisting of excited electrically neutral atoms and molecules of antimatter, and excited electrically neutral atoms and molecules of exotic matter.

2. The antimatter storage device of claim 1 wherein said PBG structure comprises materials and geometry that together provide bandgaps at frequencies specific to each species to be stored in said antimatter storage device.

3. The antimatter storage device of claim 2 wherein said PBG structure has behavior that is dependent on a periodic contrast, wherein said periodic contrast is one-dimensional, two-dimensional, or three-dimensional, in the index of refraction between different constituent elements of said PBG structure, its geometry, and spacing associated with an arrangement of said constituent elements, and shapes of said constituent elements.

4. The antimatter storage device of claim 3 wherein said material comprising said PBG structure is selected from the group consisting of inverse opal backbone, macroporous silicon, colloidal crystals, woodpile structure, Yablonovite, and the like.

5. The antimatter storage device of claim 1 wherein said excited electrically neutral species is selected from the group consisting of positronium, antihydrogen, protonium, antimuonium, molecular positronium, molecules containing positronium, positronium molecules bound to ordinary matter, and electrically neutral molecules containing a positron having a single positive charge bound to ordinary matter having a single negative charge.

6. The antimatter storage device of claim 5 wherein said excited positronium comprises an electron and a positron bound together in orbit, but separated by a first distance, and wherein said excited positronium is separated from said cavity wall by a second distance.

7. The antimatter storage device of claim 6 wherein said first distance is large enough to prevent self-annihilation but small enough to keep said electron and said positron in orbit about each other, and wherein said second distance is large enough to prevent contact of said excited positronium with said cavity wall.

8. The antimatter storage device of claim 1 comprising an array of said PBG cavities, each PBG cavity separated from its nearest-neighbor PBG cavities by a third distance.

9. The antimatter storage device of claim 8 wherein said third distance is less than the photon localization length.

10. The antimatter storage device of claim 8 wherein said third distance is greater than the photon localization length.

11. A method of capturing antimatter, said method comprising:

providing an antimatter capture device comprising, a three-dimensional or two-dimensional photonic bandgap (PBG) structure containing at least one PBG cavity therein, said PBG cavity capable of containing a quantity of species selected from the group consisting of excited electrically neutral atoms and molecules of antimatter, and excited electrically neutral atoms and molecules of exotic matter; and introducing said species into said at least one PBG cavity.

12. The method of claim 11 wherein said PBG structure comprises materials and geometry that together provide bandgaps at frequencies specific to each species to be stored in said antimatter storage device.

13. The method of claim 12 wherein said PBG structure has behavior that is dependent on a periodic contrast, wherein said periodic contrast is one-dimensional, two-dimensional, or three-dimensional, in the index of refraction between different constituent elements of said PBG structure, its geometry, and spacing associated with an arrangement of said constituent elements, and shapes of said constituent elements.

14. The method of claim 13 wherein said material comprising said PBG structure is selected from the group consisting of inverse opal backbone, macroporous silicon, colloidal crystals, woodpile structure, Yablonovite, and the like.

15. The method of claim 11 wherein said excited electrically neutral species is selected from the group consisting of positronium, antimuonium, antihydrogen, protonium, molecular positronium, molecules containing positronium, positronium molecules bound to ordinary matter, and electrically neutral molecules containing a positron having a single positive charge bound to ordinary matter having a single negative charge.

16. The method of claim 11 wherein the step of said introducing is selected from one of the following three methods:

(a) injecting said antimatter from radioactive sources or accelerator sources through a velocity moderator, either located within said PBG material of said PBG structure, or located outside said PBG structure;

(b) pair-producing positrons and electrons by high-energy gamma rays generated by electron beams or as a by-product of neutron capture processes, wherein said neutrons impinge on said PBG structure in a collimated beam, or said PBG structure is placed inside a nuclear reactor in which there is an abundance of neutrons; or (c) embedding a radioactive material that emits positrons said PBG structure, resulting in a "self-charging" device, wherein a positron is introduced into said PBG structure, picks up an electron at said wall of said cavity, and becomes a positronium atom within said cavity.

17. A method for exciting antimatter species to an excited state, comprising:

providing an antimatter excitation device comprising a three-dimensional or two-dimensional photonic bandgap (PBG) structure containing at least one PBG cavity therein, said PBG cavity containing a quantity of species selected from the group consisting of excited electrically neutral atoms and molecules of antimatter, and excited electrically neutral atoms and molecules of exotic matter;

introducing said species into said at least one PBG cavity; and exciting said species.

18. The method of claim 17 wherein said PBG structure comprises materials and geometry that together provide bandgaps at frequencies specific to each species to be stored in said antimatter storage device.

19. The method of claim 18 wherein said PBG structure has behavior that is dependent on a periodic contrast, wherein said periodic contrast is one-dimensional, two-dimensional, or three-dimensional, in the index of refraction between different constituent elements of said PBG structure, its geometry, and spacing associated with an arrangement of said constituent elements, and shapes of said constituent elements.

20. The method of claim 19 wherein said material comprising said PBG structure is selected from the group consisting of inverse opal backbone, macroporous silicon, colloidal crystals, woodpile structure, Yablonovite, and the like.

21. The method of claim 17 wherein said electrically neutral species is selected from the group consisting of positronium, antimuonium antihydrogen, protonium, molecular positronium, molecules containing positronium, positronium molecules bound to ordinary matter, and electrically neutral molecules containing a positron having a single positive charge bound to ordinary matter having a single negative charge.

22. The method of claim 17 wherein the step of said introducing is selected from one of the following methods:

(a) injecting said antimatter from radioactive sources or accelerator sources through a velocity moderator, either located within said PBG material of said PBG structure, or located outside said PBG structure;

(b) pair-producing positrons and electrons by high-energy gamma rays generated by electron beams or as a by-product of neutron capture processes, wherein said neutrons impinge on said PBG structure in a collimated beam, or said PBG structure is placed inside a nuclear reactor in which there is an abundance of neutrons; or (c) embedding a radioactive material that emits positrons in said PBG structure, resulting in a "self-charging" device, wherein a positron is introduced into said PBG structure, picks up an electron at said wall of said cavity, and becomes a positronium atom within said cavity.

23. The method of claim 17 wherein said method of exciting said species is selected from one or the following methods:

(a) using a laser tuned to an energetic state outside said PGB structure to place said species in said excited state;

(b) creating said excited species in a more highly excited state that cascades down to the proper excited state, from which further decay is inhibited by said surrounding PBG structure; or (c) achieving said excited state directly during formation of Ps*, employing radioactive sources that exhibit $\beta^+$-decay embedded in said PBG structure, such that as emitted high-energy positrons traverse said PBG material, they are slowed, and as they pass through said cavity wall, they capture an electron and form positronium in a Rydberg state, which can be said excited slate or which can be a state or higher energy that cascades down to said excited state, or it can be a state of lower energy that is laser pumped up to said excited state or up to a state of higher energy than said excited state and subsequently allowed to cascade down to said excited state.

24. A state of antimatter comprising a three-dimensional or two-dimensional photonic bandgap (PBG) structure containing an array of PBG cavities in said PBG structure, each PBG cavity separated from its nearest-neighbor cavities by a distance that is less than the photon localization length, each cavity containing a quantity of species selected from the group consisting of excited electrically neutral atoms and molecules of antimatter, and excited electrically neutral atoms and molecules of exotic matter.

25. The state of antimatter of claim 24 wherein said PBG structure comprises materials and geometry that together provide bandgaps at frequencies specific to each species to be stored in said antimatter storage device.

26. The state of antimatter of claim 25 wherein said PBG structure has behavior that is dependent on a periodic contrast, wherein said periodic contrast is one-dimensional, two-dimensional, or three-dimensional, in the index of refraction between different constituent elements of said PBG structure, its geometry, and spacing associated with an arrangement of said constituent elements, and shapes of said constituent elements.

27. The state of antimatter of claim 26 wherein said material comprising said PBG structure is selected from the group consisting of inverse opal backbone, macroporous silicon, colloidal crystals, woodpile structure, Yablonvite, and the like.

28. The state of antimatter of claim 24 wherein said electrically neutral species is selected from the group consisting of positronium, antihydrogen, protonium, antimuonium, molecular positronium, molecules containing positronium, positronium molecules bound to ordinary matter, and electrically neutral molecules containing a positron having a single positive charge bound to ordinary matter having a single negative charge.

29. The state of antimatter of claim 29 wherein said excited positronium comprises an electron and a positron bound together in orbit, but separated by a first distance, and wherein said excited positronium is separated from said cavity wall by a second distance.

30. The state of antimatter of claim 29 wherein said first distance is large enough to prevent self-annihilation but small enough to keep said electron and said positron in orbit about each other, and wherein said second distance is large enough to prevent contact of said excited positronium with said cavity wall.

31. A combination of localized photons and partially excited species to form a stationary-state superposition thereof, or a stable photon-species-cavity bound state, formed by an excited electrically neutral species of antimatter or exotic matter interacting with cavity walls of a cavity located within a photonic bandgap (PBG) structure, said interaction being mediated by photons.

32. The combination of claim 31 wherein said species is excited positronium (Ps*), which develops a very long lifetime, because it will remain in an excited state, which prevents self-annihilation from ground state, said lifetime being at least a few seconds.

33. The combination of claim 32 wherein said lifetime is extendable by proper selection of angular momentum for the excited state Ps*, said lifetime being at least a few seconds.

34. The combination of claim 32 further including externally applied crossed electric and magnetic fields to substantially enhance said lifetime extension.

35. A method of releasing gamma ray radiation, comprising:

providing an antimatter excitation device comprising a three-dimensional or two-dimensional photonic bandgap (PBG) structure containing at least one PBG cavity therein, said at least one PBG cavity containing a quantity of excited positronium; and perturbing said PBG structure such that the index of refraction contrast, the geometry, the spacing, and/or the shape of the constituent components changes in such a way as to shift or turn off the bandgap that is responsible for maintaining the positronium in an excited state to thereby release said gamma ray radiation.

36. The method of claim 35, wherein said released gamma rays either have a fixed energy of 511 keV per gamma ray for two gamma rays per positronium atom or have a distribution of energies ranging up to approximately 1 Mev for three gamma rays per positronium atom.

37. The method of claim 35 wherein said excited positronium decays to its ground state, forming a mixture of spin singlet and spin triplet states, which mixture of states produces self-annihilation from both spin states, resulting in a mixture of atoms producing two 511 keV gamma rays and atoms producing three gamma rays with a total energy of approximately 1 MeV.

38. The method of claim 37 wherein a 203 GHz pulse is applied to the trapped positronium atoms to de-excite said atoms in said spin triplet state to said spin singlet state, thereby enhancing production of two 511 keV gamma rays per atom and reducing production of three gamma rays with total energy approximately 1 MeV per atom.

39. A beam of species comprising excited electrically neutral atoms or molecules of antimatter or excited electrically neutral atoms or molecules of exotic matter emitted by a photonic bandgap (PBG) structure containing at least one PBG cavity therein, said at least one PBG cavity containing a quantity of said species, said beam comprising said species channeled out of said PBG structure into a desired direction by opened linear defect waveguides in said PBG structure.

40. A particle beam comprising electrically charged antimatter emitted by a photonic bandgap (PBG) structure containing at least one PBG cavity therein, said PBG cavity containing a quantity of excited electrically neutral atoms or molecules of antimatter or excited electrically neutral atoms or molecules of exotic matter, said excited electrically neutral atoms or molecules then ionized by an electric field, with electric and magnetic fields used to direct the ions out of the PBG device.

* * * * *